United States Patent [19]

Baker et al.

[11] 4,315,749

[45] Feb. 16, 1982

[54] NON JAMMING REVERSIBLE JET NOZZLE

[75] Inventors: Kenneth R. Baker, Woodland Hills; Robert T. DeVault, Simi Valley, both of Calif.

[73] Assignee: Maritec Corporation, Los Angeles, Calif.

[21] Appl. No.: 69,740

[22] Filed: Aug. 27, 1979

[51] Int. Cl.[3] ..... B63H 11/00

[52] U.S. Cl. ..... 440/42; 60/221; 239/265.19; 440/41; 440/47

[58] Field of Search ..... 60/221; 114/222, 151; 440/38, 40–43, 47; 239/265.11, 265.19, 265.33–265.41

[56] References Cited

U.S. PATENT DOCUMENTS

| | | | |
|---|---|---|---|
| 3,185,124 | 5/1965 | Spence | 239/265.19 |
| 3,347,203 | 10/1967 | Starry | 440/41 |
| 3,465,705 | 9/1969 | Castoldi | 440/41 |
| 3,906,885 | 9/1975 | Woodfill | 440/41 |
| 3,982,494 | 9/1976 | Posti | 440/43 |
| 4,030,442 | 6/1977 | White | 440/42 |

*Primary Examiner*—Galen L. Barefoot
*Assistant Examiner*—D. W. Keen
*Attorney, Agent, or Firm*—William H. Maxwell

[57] ABSTRACT

A reversible hydrojet boat drive for the substantially nonturbulent nozzling of water during the forward mode, and effective non jamming seal function during the reverse mode, and comprised of an exact nozzle continuation of the exit passage of the pump, particularly the top wall thereof, and the compatible eccentric relation of the surrounding seals of the reverse gate centered below the axis of gate rotation, thereby to avoid jamming and to eleviate strain on the control system therefor.

10 Claims, 8 Drawing Figures

NON JAMMING REVERSIBLE JET NOZZLE

This application is copending with and contains subject matter originally disclosed in application Ser. No. 591 filed Jan. 2, 1979.

BACKGROUND

The water flow from marine propulsion jets tends to be turbulent and difficulty is experienced in coordinating the seal around its edges when in the reverse steering mode. It is not only the directed axis of the jet but the turbulence which results in diverging spray which is thrown upward in the form of a "rooster tail" that interferes with skiers and accounts for a slight thrust loss. And the reverse mode must be cooperatively related to the forward mode and both steerable, without being subject to jamming in the presence of sand and mud or other debris. It is a general object therefore, to match the nozzle with the cross sectional configuration of the pump exit, both with respect to flow in the forward mode and to seal when in the reverse mode.

It is a primary object of this invention to supress spray that is normally thrown upward from jet nozzles. Heretofore, exit passage and nozzle design has not been altogether compatable with the steering function, and nozzles have not been perfect continuations of the pump exit passage. For example, the usual exit nozzle configuration is that of a cylindrical tube, the nozzle being on a swivel so as to turn from side to side, but without any means embodied in the nozzle per se to supress the jet. With the present invention turbulence and upward diversion of spray is supressed by providing a flattened exit passage and correspondingly shaped nozzle, both matched with respect to the side walls thereof, and particularly with respect to the top wall thereof. By matching the plane of the top walls of the exit passage and nozzle passage, the thrust flow remains perfectly straight and level, without thrust losses and reducing the turbulence so that upward divergence of the jet is substantially eliminated.

It is also an object of this invention to seal around the jet nozzle when in the reverse mode, and all without being subject to jamming. Heretofore, reverse gates have been cylindrical or spherical, and actuable about a centered axis or pivot point. Consequently, sliding motion between closely fitting parts has been characteristic, resulting in reverse gates that are vulnerable to the presence of any foreign matter. Replacement of the rotative center has been proposed but is not satisfactory alone, since hydraulic pressure in the reverse mode forces the gate open. Therefore, it is an object herein to relocate the center of curvature of the side seals, heretofor concentric with rotation but now eccentric thereto. As a result, hydraulic pressure does not tend to open the gate and there is no adverse reaction on the control system therefor. The seals have line contact, with an angular separating motion rather than a sliding motion.

SUMMARY OF THE INVENTION

This invention relates to a jet nozzle for high speed boat operation, and which is adapted to operate without undue turbulence thereby to substantially reduce the usual "rooster tail", and also to a reverse system that is adequately sealed and non jamming. The basic boat hull and jet propulsion drive installation remains substantially unchanged, the exit passage of the pump and nozzle being cooperatively matched so as to substantially eliminate turbulence and associated with a reverse gate that seals around the jet opening when in the reverse mode. In practice, the nozzle is mated to the rectangular configuration of the reformed exit passage of the pump, and the top walls thereof continue in planar alignment one with the other. The reverse gate has line contact that separates angularly, not sliding, and the arcuate center of the side seals is such that hydraulic pressure does not force the gate to open. Accordingly, the usual "rooster tail" is lowered and/or practically eliminated during high speed operation, and the reverse mode is easily controlled without stressing the controls and with effective sealing around the nozzle.

DRAWINGS

The various objects and features of this invention will be fully understood from the following detailed description of the typical preferred form and application thereof, throughout which description reference is made to the accompanying drawings, in which.

Figures 3, 4, 5:
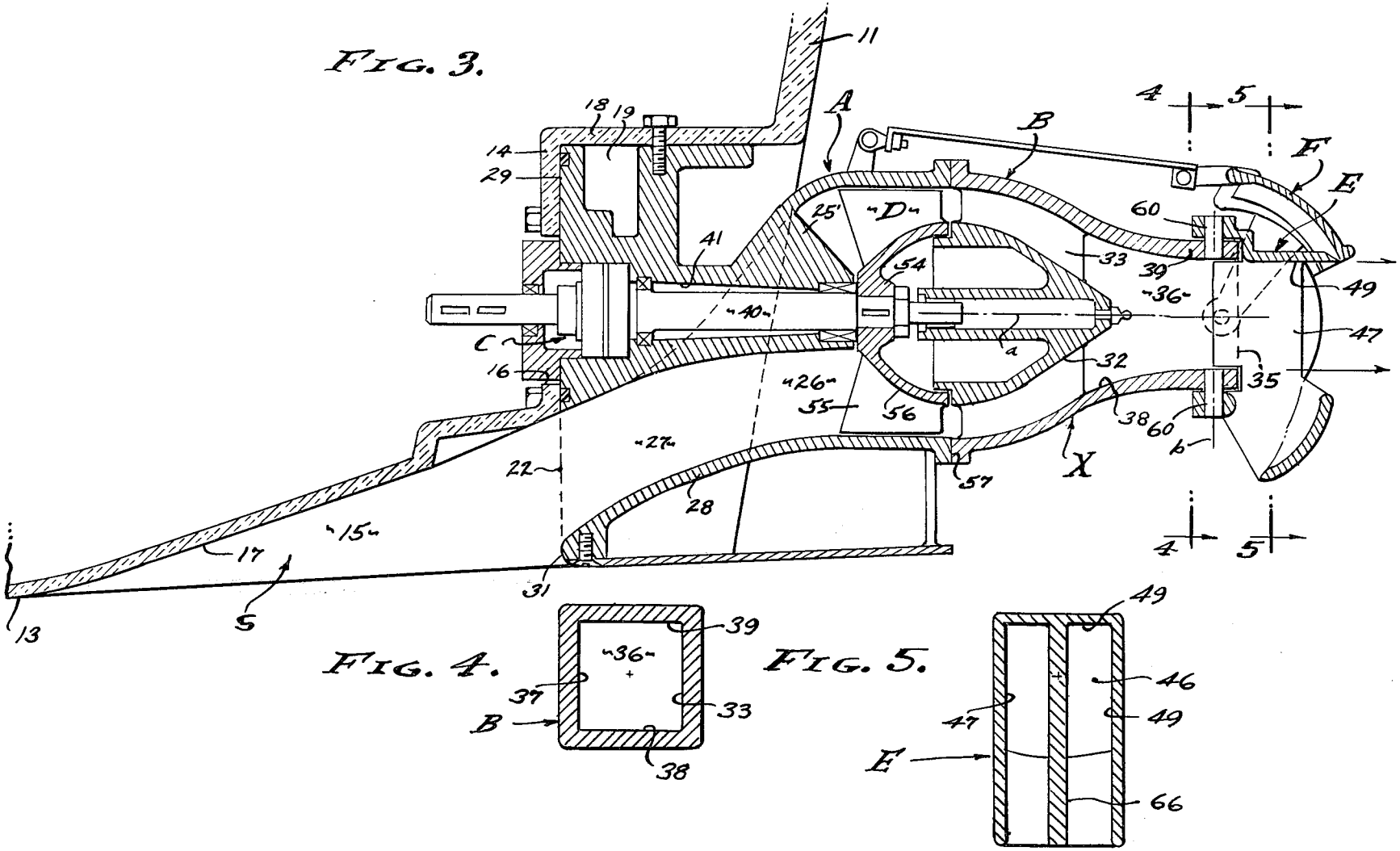
FIG. 3 is a reduced longitudinal sectional view taken as indicated by line 3—3 on FIG. 2, and shown in the forward mode.

FIGS. 4 and 5 are sectional views taken as indicated by lines 4—4 and 5—5 on FIG. 3.

Figure 6:
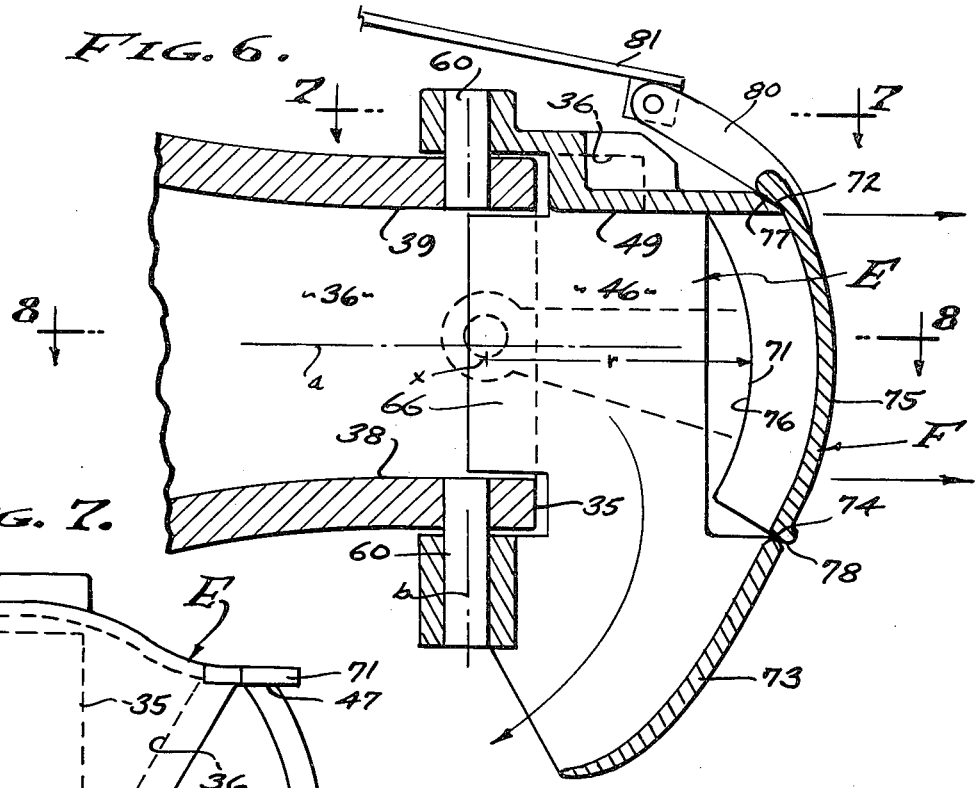

FIG. 6 is an enlarged sectional view of the nozzle and reverse gate, shown in the reverse mode.

Figure 7:
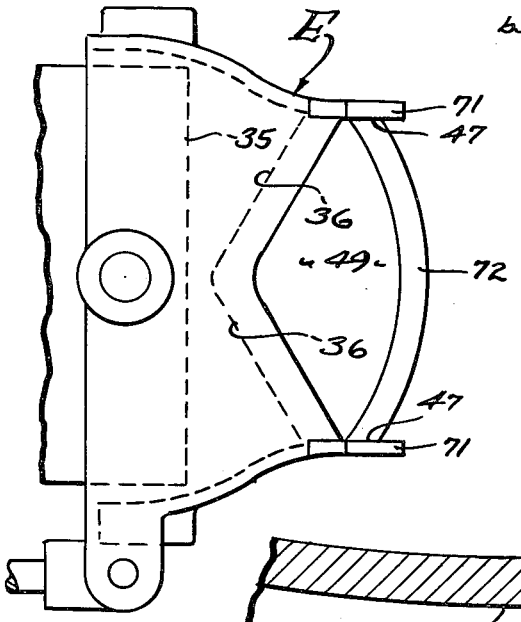

FIG. 7 is a plan view of the nozzle, with the reverse gate removed, taken as indicated by line 7—7 on FIG. 6.

Figure 8:
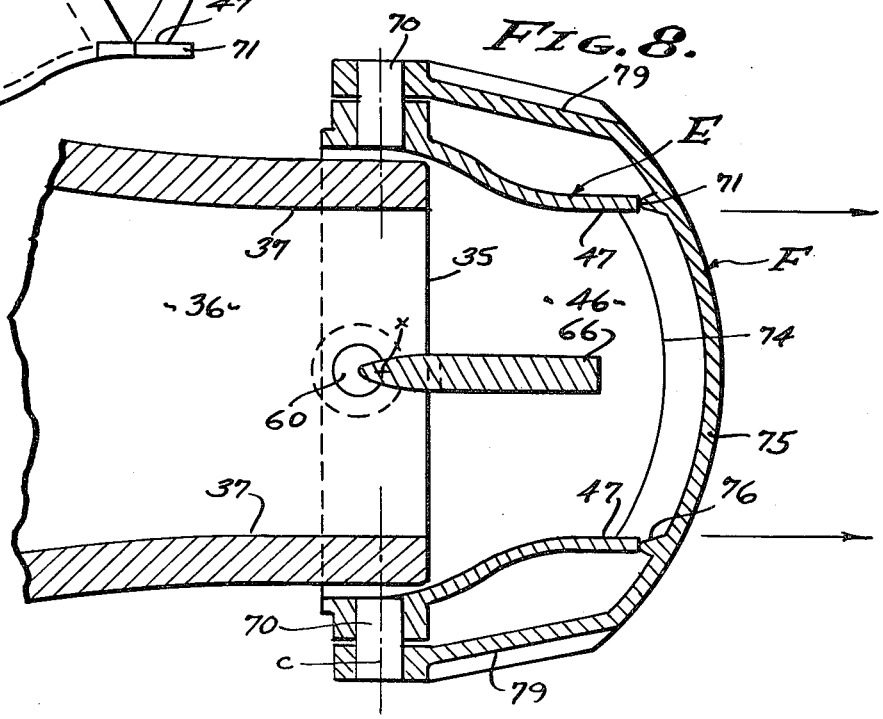

And, FIG. 8 is a sectional view of the nozzle and reverse gate taken as indicated by line 8—8 on FIG. 6.

PREFERRED EMBODIMENT

Figure 1:
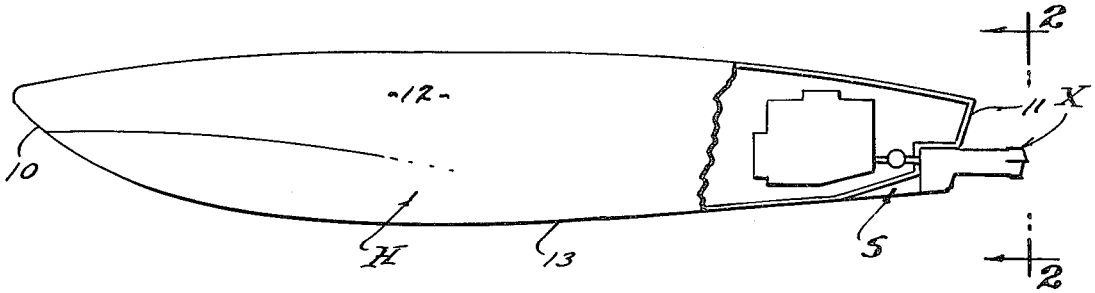
FIG. 1 is a side elevation view of the combination of a boat hull and the hydrojet boat drive unit of the present invention.
Figure 2:
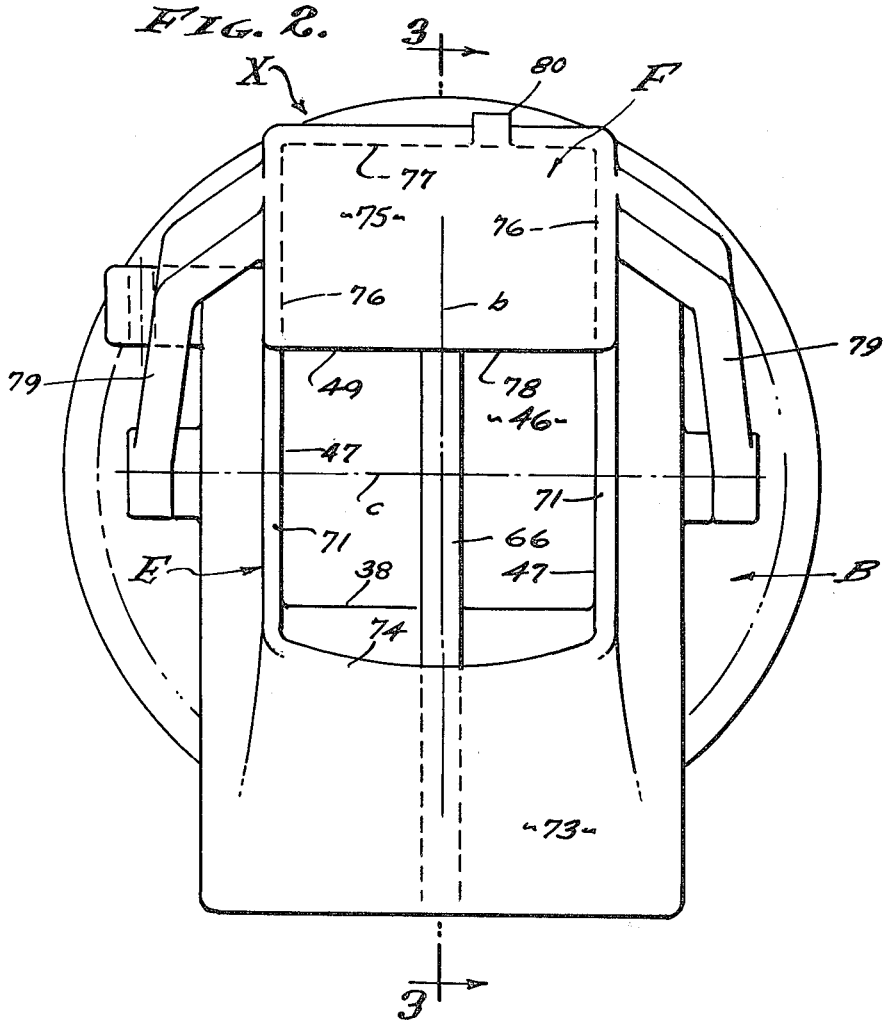
FIG. 2 is an enlarged rear view taken as indicated by lines 2—2 on FIG. 1.

The hydrojet boat drive X is installed at the exterior of the vessel or hull H to be propelled thereby. It is to be understood that the boat hull H can vary widely, a typical "V"-shaped hull as shown in FIG. 1 of the drawings. As shown, the hull H comprises a bow 10, a stern or transom 11, top-sides 12, and fair "V" bottom lines 13 that extend from bow to stern. A typical configuration is illustrated wherein the fair lines 13 of the bottom are generally flat and wherein the top-sides and bottom are truncated by a flat transverse transom 11 slanted upwardly and rearwardly.

In accordance with this invention, a slot S is formed in the hull H for accommodating the drive X as a unit, the slot comprising a bulkhead 14 and a tunnel 15. Although the bulkhead 14 can be disposed at various angles, it is preferred that it be vertically disposed for the reception of the mounting face of the drive unit, in which case there is a central opening 16 through the bulkhead for entry of the pump shaft into the hull 11 on a horizontal axis. Also, the tunnel 15 can be disposed at various angles of incidence, it being preferred that the top wall 17 of the tunnel be rearwardly inclined at 25°, more or less, where it terminates at the plane of the bulkhead 14. As shown where the transom 11 is rearwardly slanted, the bulkhead is recessed forwardly from the transom establishing a chest having a top 18 and side walls 19 to receive the pump housing of the unit. The walls 19 are suitably spaced to receive the cross section of the unit X and the tunnel 15 has side walls 21 that extend forwardly from said chest. Characteristically therefore, both the said chest and openly adjoining tunnel 15 are downwardly open with structurally reinforcing vertically disposed side walls continuing one into the other, and with the tunnel top 17 faired from the bottom lines 13 and tangentially with the top wall of the inlet plenum later described. It will be seen that the bulkhead 14 and tunnel 15 forming the slot S are easily formed and are structurally sound for the reception of both mounting and thrust forces to be imposed by the drive unit X, as well as drag forces impared by the scoop Z.

The slot S is of substantial width and forms a wide-mouthed flush opening when combined with the pump housing to be described. Intake into the drive X is at the plane of joinder between the bulkhead 14 and the pump housing, there being an interface opening 22 at said plane between the bulkhead 14 and the pump housing. The divergent widening angle of the tunnel 15 is 30° to 36° (inclusive) as shown, for transmission of the intake propulsion water from the apex of the "V" bottomed hull H to the interface opening 22.

The hydrojet drive X is a pump unit that involves generally, a pump housing A, a stator housing B, bearing and seal means C, an impeller D, a nozzle E, and the necessary control means as indicated in the drawings. The housings A and B are separable with a flow passage 26 extending longitudinally therethrough in which the impeller D is journaled upon the bearing and seal means C on a horizontal axis. The nozzle E receives the pressure discharge of water from the stator housing and is carried thereby to directionally discharge the said water. Reverser means and steering means are independently operable and cooperatively carried by the nozzle as is shown.

The pump housing A is the main body of the unit and comprises the forward portion of the flow passage 26 establishing the interface opening 22 and entry plenum 27. The plenum 27 and continuing flow passage 26 are formed by a tubular side wall 28 of the housing A, the plenum 27 being inclined from the scoop 22 opening beneath the bearing means C at the front face 29 of said housing. The initial entry area at opening 22 is of low profile widened rectangular cross section which narrows and gains height as it inclines rearwardly to merge with a cylindrical wall of flow passage 26 surrounding the impeller. In practice, the inclination of plenum 27 is increased and/or curved upwardly and is then recurved around and to have an axis coincidental with the impeller axis a, as said plenum extends rearwardly and is faired into the flow passage 26. The interface opening 22 features a lower entry lip 31 that presents an oval-round leading edge for the usual entry through the slipstream of water passing beneath the boat hull and from the tunnel 15 therein. A hydrodynamic fin or blade-like fairing 25' occupies the flow passage space 26 between the wall 28 thereof from which the pump shaft 40 emerges and the impeller D or entry cone 56 thereof. The fairing 25' is a tubular extension of bore 41 that houses the pump shaft coextensively between its emergence to the entry cone, and from which a fin projects vertically on the center plane to meet the wall 28 and fully occupy the space therebetween above the pump shaft. Operationally, the fairing 25' straightens the flow of water into the impeller D and prevents wrapping of debris around the pump shaft 40, thereby enhancing the operation by preventing entanglements which otherwise might deposit around said pump shaft.

The entry lip 31 is substantially forward of the transom 11, by the provision of the recessed bulkhead 14. By this means the interface opening 22 is at the foremost plane of the pump housing A coincidental with the plane of bulkhead 14 and is immersed in water confined beneath the bottom 13; and all of which reduces the possibility of cavitation, especially when in the reverse mode of operation. The above described pump housing A is fastened directly to the slot S of the boat hull for its cantilevered support and to structurally participate in the beam strength of the boat hull. Accordingly, screw fasteners are entered into any one and preferably all four planar faces of the pump housing A that are fitted firstly to the bulkhead 14, secondly the top wall 18, and thirdly and fourthly to the opposite side walls 19.

The jet housing or stator housing B is separable from the pump housing A at the full diameter of the latter and in a plane normal to the impeller axis a. Broadly, the stator housing and elements carried thereby is a control means that directs the water pumped rearwardly therefrom. As shown, the two housings are joined by a bolted flange connection with the flow passage 26 continuing as an annulus defined by a re-entry cone 32 carried centrally therein by stator blades 33 extending radially between the tubular side wall 38 and said cone 32. The stator blades 33 have leading edges immediate to the plane of joinder between said housings and they are canted so as to receive the helical flow of water from impeller D and they are recurved to turn said flow of water axially and thereby pressurize the same. As shown, the wall 38 is converged over the re-entry cone 32 merging from the annular passage 26 to the nozzle E.

The impeller D is bladed for axial flow discharge of water through the annular flow passage 26, and to this end is comprised of a hub 54 from which helically canted blades 55 project radially so as to substantially occupy the annulus of passage 26. The hub 54 carries a fairing in the form of an entry cone 56 that distributes plenum water to flow unrestrictedly into the cylindrical portion of flow passage 26. The hub 54 is keyed to pump shaft 40 forwardly of the plane of joinder between housings A and B, and the cone 56 flairs outwardly and rearwardly therefrom to merge tangentially with the outer diameter of re-entry cone 32. In practice, the combined cones 32 and 56 are telescopically interengaged and sealed as by means of a labyrinth, or the like, and together they are generally ovular or egg-shaped in longitudinal cross section, and the trailing edges of the rotor blades 55 being juxtaposed closely to the leading edges of the stator blades 33. A pressure seal 57 is provided at the plane of joinder between the two housings when brought together to enclose the impeller.

The nozzle E is incorporated in selectively positionable elements which characterize the present invention, and the directional control afforded by the steerable nozzle E is cooperatively mated with a reverse gate F as shown in the drawings. A feature is the cross sectional configuration of the exit flow passage 36 mated with the nozzle flow passage 46, and both of which are rectangular and characterized by flat horizontally disposed top walls in a common plane. As shown in FIG. 4, the exit flow passage 36 is substantially square with flat side walls 37 and flat bottom and top walls 38 and 39. The terminal end 35 of flow passage 36 is in a plane normal to the central axis a, the turning axis b being vertical and closely forward of and parallel to said terminal end 35 of the stator housing section B. The nozzle E is pivoted to swing over the terminal end of the housing B on vertically disposed trunions 60 projecting from the outside of the housing. The reverse gate F is carried on a horizontally disposed trunion axis c by the turning nozzle E, there being laterally disposed trunions 70 projecting from the outside of the nozzle to carry said gate. The nozzle E turns from side to side with the reversing gate F in either the open forward mode as shown in FIG. 3, or in the reverse mode as shown in FIG. 6 sealed with the top 49 and to side walls 47 of the nozzle passage (line contact seals).

The nozzle passage 46 forms a rearward extension of the exit passage 36 and is comprised of side walls 47 and a top wall 49 supported upon a rudder vane 66 rotatable on and extending between the trunions 60. The rudder vane is notched to embrace the top and bottom walls 39 and 38, with the leading edge thereof coincidental with the turning axis b. In carrying out this invention, the nozzle E turns 30° in each direction (side to side) and accordingly the side walls 47 are flared to embrace the side walls 37 of the housing B, with outside clearance sufficient to permit said turning movement (see FIG. 7). The trailing portions of the walls 47 are in the same planes as walls 37 when the nozzle is centered, the walls 47 being curved forwardly, as shown in FIG. 8, to carry the trunions 70 on the reverse gate axis c. In order to permit said 30° turning of the nozzle E, the top wall 49 is divergently recessed at opposite sides to receive the terminal end 35 of top wall 39. Said accomodating recesses 36 are best illustrated in FIG. 7; forming a flat faced mechanical stop, and so that the trailing portion of top wall 49 remains exactly in the plane of wall 39 (see FIG. 6).

In accordance with this invention the non jamming reverse gate F is operable between the forward and reverse modes while the pump is in operation. The gate axis c for the trunions 70 is displaced rearward of the nozzle axis b and at and preferably above the axis a (see FIGS. 6 and 8). These offset axes are significantly related to the center x about which the seals of the reverse gate are formed, center x being located rearward of axis b and substantially below axis c (see FIG. 6). Accordingly, the nozzle-gate seals are comprised of opposite semi-cylindrical faces 71 formed on the rear edges of walls 49 respectively on radius r concentric with center x, and a frustrum of a cone disposed on an axis normal to and intersecting the axis c and center x to present an upwardly and rearwardly faced chamfer 72 forming the rear edge of wall 49. The gate axis c is therefore placed substantially above the geometric center x about which the faces 71 are oriented, and the face 72 is faced away from said center c about which the gate rotates.

The lower skirt 73 of the nozzle is recurved forwardly to redirect the water flow in a reversing direction as indicated, and the uppermost edge thereof presents a transverse lip 74 of arcuate form extending between the side walls 47 (see FIG. 8). The lip 74 is rearwardly convex and faces upwardly to engageably stop the gate F next to be described. In the forward mode with the gate opened, the water-flow continues from walls 37 and 39 to flow over walls 47 and 49 from which it separates at the rear edges of the nozzle defined by the sealing faces 71 and 72.

The reverse gate F is a shutter or "blind" comprised of a door 75 that opens and closes the nozzle opening defined by the seal faces 71,72 and lip 74. The door 75 is hemispherically formed and thereby adapted to closely fit the faces 71, 72 and lip 74 herein above described. Accordingly and when considered in the reverse mode position, the door presents a pair of side ribs 76 to coextensively engage and seal with faces 71, an upper face 77 to coextensively engage and seal with chamfered face 72, and a lower lip 78 to coextensively engage and seal with the lip 74. The side ribs 76 are arcuately formed about center x to be coincidental with and establish line contact with faces 71 (see FIG. 8). The upper face 77 is arcuately formed about center x as a frustrum of a cone to be coincidental with and establish face to face contact with face 72 (see FIG. 6). And, the lower lip 78 is arcuately formed about center x in an arc coincidental with and to establish face to face contact with the lip 74. A feature is the hemispherical configuration of the door 75 and its marginal sealing members coextensively engaging the nozzle sealing faces, all of which are geometrically formed about the center x offset from the rotational axis c of the gate. As shown, the door 75 is carried by opposite side arms 79 journaled on the trunions 70, with a lever arm 80 to be shifted with a link 81.

From the forgoing it will be understood that the pump flow from impeller D is reformed from an annulus surrounding the reentry cone 32 and into a circular flow passage 36 that is transformed into a rectangular exit passage at the end 35 of the stator housing B. Accordingly, the exit passage is characterized by flat side walls 37 and flat top and bottom walls 39 and 38. The nozzle E then forms an exact continuation of wall 37 in the walls 47 when considered in the straight steered condition; and particularly to form an exact continuation of wall 39 in the wall 49 under all steered conditions. It is most significant that the wall 49 forms an exact continuation of the exit passage and nozzle passage, since this effectively reduces turbulence and substantially eliminates excessive "rooster tail". When in the forward mode the reverse gate F is clear of the nozzle passage (above wall 49), and when shifted into the reverse mode the sealing members 76–78 of the door 75 angularly approach the sealing faces 71 and 72 and lip 74 of the nozzle E, and with a corresponding angular separation when shifted from the reverse mode. The center x offset with respect to the rotational axis c of the gate F and the provision of sealing interfaces formed concentric with said center x prevents hydraulic pressure from over reacting upon the control system of positioning levers and links. Also, jamming along the sealing interfaces is virtually eliminated by the angular approach and separation, and non-jamming ensured by the line contact wherein interengagement is made as thin as possible.

Having described only a typical preferred form and application of my invention, I do not wish to be limited or restricted to the specific details herein set forth, but wish to reserve to myself any modifications or variations that may appear to those skilled in the art:

We claim:

1. A reversible hydrojet drive unit for boat propulsion and including, a water pump housing terminating in a horizontal rearwardly opening exit flow passage having top and bottom and side walls parallel to a propulsion axis, a prime mover driven impeller operable in said housing to deliver propulsion water rearwardly from said exit flow passage, a steering nozzle embracing the exit flow passage and with top and side walls forming continuations of said top and side walls of said exit flow passage and having a depending forwardly recurved skirt and rotatable on a vertically disposed axis upon trunions projecting from the said pump housing immediate to the rearwardly opening exit flow passage thereof, the said steering nozzle having a central vertically disposed rudder vane depending from the top wall thereof and with its leading edge coincidental with the said vertically disposed axis to steer and to reduce turbulence, and a reverse gate having a shiftable door to open and to close the nozzle for forward redirection of propulsion water by said recurved skirt.

2. The reversible hydrojet drive unit as set forth in claim 1, wherein the rearwardly opening exit flow passage of the pump housing is of flattened cross sectional configuration, and wherein the side walls of the steering nozzle are in exact planar alignment with the said flat side wall of the exit flow passage when in the straight steering position.

3. The reversible hydrojet drive unit as set forth in claim 1, wherein the rearwardly opening exit flow passage of the pump housing is of flattened cross sectional configuration, and wherein the top wall of the steering nozzle is in exact planar alignment with the said flat top wall of the exit flow passage at all steering positions.

4. The reversible hydrojet drive unit as set forth in claim 1, wherein the rearwardly opening exit flow passage of the pump housing is of flattened rectangular cross sectional configuration, wherein the flat side walls of the steering unit are in exact planar alignment with side walls of the exit flow passage in a straight steering position, and wherein the flat top wall of the steering nozzle is in exact planar alignment with the top wall of the exit flow passage at all steering positions.

5. The reversible hydrojet drive unit as set forth in claim 1, wherein the steering nozzle rudder vane extends vertically between the top wall and recurved skirt thereof.

6. The reversible hydrojet drive unit as set forth in claim 1, wherein the rearwardly opening exit flow passage of the pump housing is of flattened rectangular cross sectional configuration, wherein the flat side walls of the steering nozzle are in exact planar alignment with the side walls of the exit flow passage when in a straight steering position, wherein the flat top wall of the steering nozzle is in exact planar alignment with the of the exit flow passage at all steering positions, and wherein the steering nozzle rudder vane extends vertically between the top wall and recurved skirt thereof.

7. A reversible hydrojet drive unit for boat hull propulsion and including, a water pump housing terminating in a rectangularly cross sectioned horizontal rearwardly opening exit flow passage having a pair of flat side walls and a top wall and said walls parallel to a propulsion axis, a prime mover driven impeller operable in said housing to deliver propulsion water rearwardly from said exit flow passage, a steering nozzle embracing the exit flow passage and having side walls terminating in rearwardly disposed semi-cylindrical edges and a forwardly recurved skirt depending from an opening defined by said side wall edges and a top wall edge, and the skirt having a lip defining the lower extremity of said opening in the gate, and a reverse gate having edges conforming to and engageable with the edges of said steering nozzle side walls and skirt lip defining the opening in the steering nozzle, and carried by arms embracing the steering nozzle and rotatable on a transverse horizontally disposed axis by trunions projecting from the said steering nozzle, the said semi-cylindrical edges of the nozzle being formed about a center disposed below the said transverse horizontally disposed axis of the gate, for angular separation of the gate.

8. The reversible hydrojet drive unit as set forth in claim 7, wherein the reverse gate has ribs with line contact against the semi-cylindrical edges of the nozzle to seal therewith.

9. The reversible hydrojet drive unit as set forth in claim 7, wherein the top wall of the steering nozzle is a frustrum of a cone formed about a center disposed below the said transverse horizontally disposed axis of the reverse gate, the top edge of the gate having a face engageable coextensively therewith.

10. The reversible hydrojet drive unit as set forth in claim 7, wherein the reverse gate has ribs with line contact against the semicylindrical edges of the nozzle to seal therewith, and wherein the top wall of the steering nozzle opening is a frustrum of a cone formed about a center disposed below the said transverse horizontally disposed axis of the reverse gate, the top edge of the gate having a face engageable coextensively therewith.

* * * * *